US005493830A

United States Patent [19]

Saarelainen

[11] Patent Number: 5,493,830

[45] Date of Patent: Feb. 27, 1996

[54] TIMBER ELEMENT AND PROCEDURE FOR MANUFACTURING A TIMBER ELEMENT

[75] Inventor: Reino Saarelainen, Järvenpää, Finland

[73] Assignee: Honkarakenne Oy, Jarvenpaa, Finland

[21] Appl. No.: 190,042

[22] PCT Filed: Jun. 18, 1992

[86] PCT No.: PCT/FI92/00190

§ 371 Date: Jan. 31, 1994

§ 102(e) Date: Jan. 31, 1994

[87] PCT Pub. No.: WO93/03897

PCT Pub. Date: Mar. 4, 1993

[30] Foreign Application Priority Data

Aug. 13, 1991 [FI] Finland ..... 923832

[51] Int. Cl.[6] ..... B27M 3/00; E04C 3/12; B27D 1/00

[52] U.S. Cl. ..... 52/233; 52/574; 52/578; 144/329; 144/345; 144/348; 144/352; 144/362; 144/380; 156/182; 156/257; 156/300; 428/58; 428/134; 428/136

[58] Field of Search ..... 156/102, 205, 156/219, 250, 254, 257, 264, 265, 300; 52/233, 574, 578; 428/106, 107, 58, 53, 134, 136, 155, 191; 144/2.12, 3.29, 345, 348, 352, 362, 364, 380

[56] References Cited

U.S. PATENT DOCUMENTS

| | | | |
|---|---|---|---|
| 2,040,110 | 5/1936 | Tahvonen et al. | 52/233 |
| 2,525,659 | 10/1950 | Edson et al. | 52/233 |
| 3,863,409 | 4/1975 | Fell . | |
| 3,992,838 | 11/1976 | Vizziello | 52/233 |
| 4,429,500 | 2/1984 | Farmont . | |
| 4,442,876 | 4/1984 | Koike et al. | 144/362 |
| 4,443,990 | 4/1984 | Johnson | 144/346 |
| 5,040,582 | 8/1991 | Hsu | 144/346 |
| 5,109,898 | 5/1992 | Schacht | 144/346 |

FOREIGN PATENT DOCUMENTS

| | | |
|---|---|---|
| 79966 | 11/1989 | Finland . |
| 2827308 | 10/1980 | Germany . |
| 191952 | 10/1964 | Sweden . |
| 289392 | of 0000 | United Kingdom . |

*Primary Examiner*—W. Donald Bray
*Attorney, Agent, or Firm*—Merchant, Gould, Smith, Edell, Welter & Schmidt

[57] ABSTRACT

The invention concerns a timber element and a procedure for manufacturing such a timber element. The timber element (14b) is composed of at least two heavy wooden blanks (2) fitted one upon the other and glued to each other by their substantially horizontal faces. As taught by the invention, each wooden blank (2) is provided on at least on horizontal face with a guiding recess (6; 6a, 6b) longitudinal to the wooden blank and vertical, for guiding the crackling to occur vertically.

6 Claims, 2 Drawing Sheets

TIMBER ELEMENT AND PROCEDURE FOR MANUFACTURING A TIMBER ELEMENT

BACKGROUND OF THE INVENTION

The invention concerns a timber element.

The invention also concerns a procedure for manufacturing a timber element.

Round timbers and dressed timber made from one log are known in prior art. These normal, conventional timbers are frequently subject to cracking as the dry out, in such a way that the splits and cracks become visible on the side faces, that is, in the walls of the timber building. The detriment from such cracks is, primarily, aesthetic deficiency: a cracked wall surface is no nice view. A further drawback resulting from the cracks is impaired insulating capacity of the wall and, further, ready access of water from the exterior surface, through the cracks into the wood, where damage is likely to ensue.

The state of art knows a timber element which is composed of at least two timber blanks which have been fitted together and glued to each other. A timber element of this kind, and a procedure for manufacturing same, is disclosed in the Finnish Patent No. 79966.

In the reference cited, the timber element is made of a wooden blank which has been sawn from a log so that the heartwood portion of the timber lies closer to the horizontal faces of the ultimate timber element than to its vertical faces exposed to external view. When this principle is followed, cracks will appear in the wooden blank, and also in the timber element, mainly on the sawn surfaces lying close to the heartwood, i.e., in the interior of the timber element.

The drawback embarrassing the procedure of the reference is that the cutting of the wooden blank from the log is done with very special arrangements; the cutting is done, arranging the heartwood portion of the wooden blank to lie closer to two given, opposed sides than to the other two opposed sides. The wooden blanks are joined to each other only by those sides which lie closer to the heartwood portion, to form a timber element. This procedure aims to benefit of the known fact that cracks will form in the wood substance on those surfaces which are closest to the heartwood, when the timber is being dried. However, the procedure implies careful control and it is therefore highly labour-intensive. Moreover, the log is not used efficiently when the wooden blank is cut in this manner. All these circumstances contribute to higher manufacturing costs of the timber element.

SUMMARY OF THE INVENTION

The object of the present invention is to disclose a novel timber element and a novel procedure for manufacturing such a timber element in which the drawbacks and problems discussed above can be substantially avoided. The object of the invention is, in particular, to provide a timber element which is favourable in manufacturing cost and the manufacturing process of which is, furthermore, simple and reliable.

The timber element of the invention is composed of at least two heavy wooden blanks, or deals, fitted one upon the other and joined to each other by gluing at their substantially horizontal faces. As taught by the invention, each wooden blank is provided on at least one horizontal face with a guiding recess, longitudinal to the wooden blank and substantially vertically directed, to the purpose of guiding the cracking to take place in a vertical direction. The direction of any cracks that may appear in the wooden blank is likely to run towards said guiding recess because the crack distance is shortest in this particular direction, and this is therefore the direction in which the deformation stresses produced in the wood when it dries out are most advantageously discharged. There may be just one guiding recess longitudinal to the wooden blank, or there may be several recesses side by side.

In an embodiment of the invention, said recess is formed of a plurality of short recesses disposed with a spacing on one line. It is thus understood that the guiding recess may either be one coherent, straight recess with a length substantially equalling the length of the wooden blank, or a number of consecutive, short recesses in a line.

In an embodiment of the invention, the recess has a wedge-shaped cross-section. Such a wedge-shaped, or conical, recess tapering in the inward direction from the surface of the wooden blank is a natural starting point for any crack which may come into being, whereby its guiding effect is likely to be better than that of any other shape of recess, e.g. of a groove with flat bottom.

The procedure of the invention for manufacturing a timber element is characterized by that which is stated in claim 4.

In the procedure of the invention for manufacturing a timber element from logs, heavy wooden blanks are cut, these blanks are dried and glued together by their horizontal sides, at least two high, to form timber element blanks, which are planed prior to being glued together by their horizontal faces, and the timber element blank produced by gluing of these wooden blanks being machined to ultimate shape, to become a timber element such as is desired. As taught by the invention, the wooden blanks are provided, subsequent to being cut, on at least one of their opposed horizontal faces with a guiding recess longitudinal to the wooden blank and substantially vertical, to the purpose of guiding any cracks to run in a vertical direction.

It should be noted that the log cutting takes place in normal manner, considering the predetermined dimensions of the wooden blank, or deal. In all other respects the cutting operation can be managed so as to obtain as its result the optimum quantity of usable sawn timber. The green, sawn wooden blank is then provided with a guiding recess in such a face which will be located inside in the ultimate timber element and/or in the top and/or bottom face of the wooden blank. Alternatively, guiding recesses may equally be provided in two opposed, horizontal faces of such a wooden blank. When, thereafter, the wooden blank is dried, these guiding recesses have the effect that any cracks which form as a result of drying will in all likelihood appear just on the surfaces which were provided with guiding recesses and they will therefore be located in the interior of the timber element that is being produced, or on its top or bottom face. The cracking distance from the centre of the wooden blank to the guiding recess is comparatively minor and therefore the stresses incurred in drying are likely to find their discharge in the form of cracks towards the guiding recesses. The guiding recesses on the wooden blanks will work in like manner in the completed timber element that has been composed of them. Thus the probability is high that those sides of the timber element which constitute the wall surfaces in the completed timber building will remain whole and free of cracks, which is the object of the invention.

In an embodiment of the procedure of the invention, the guiding recess is shaped to present a conical cross section.

The guiding recess may alternatively be shaped to be a flat-bottomed groove, but a milling cutter or circular saw would have to be used to achieve this. A conical guiding recess is readily accomplished using e.g. a suitable, wedge-like blade arrangement; in that case there will for instance be no objectionable clouds of sawdust. Moreover, such a wedge-shaped recess is in a way a nucleus for splitting and this should facilitate the guiding of any drying cracks specifically towards the guiding recess.

In an embodiment of the procedure of the invention, the guiding recess is incised in a horizontal face of the wooden blank. This can be implemented by moving the wooden blank on a conveyor past a suitable blade means, said blade means being caused to slash a guiding recess of appropriate depth longitudinally to the wooden blank in one horizontal face thereof, or in two opposed horizontal faces.

In an embodiment of the procedure of the invention, the guiding recess is provided in a horizontal face of the wooden blank in the form of short recesses spaced from each other. It is thus understood that the guiding recess need not be any continuous recess: it can well be implemented in the form of consecutive recesses disposed in a line, with intact wood substance between them. Such serially arranged recesses are sufficient to guide the splitting, or crack formation, to occur specifically in that region of the wooden blank where they have been provided.

In an embodiment of the procedure of the invention, the guiding recess is embossed in a horizontal face of the wooden blank, using a rotating blade wheel on which mutually spaced blade elements, such as teeth, have been provided. In that case, the wooden blank can be moved on the conveyor past one or two blades so that at least one of the two horizontal faces becomes embossed with the desired kind of short, serially disposed recesses, which constitute the guiding recess in this case. It is also possible, on the other hand, to use the blade wheel as transport means for the wooden blank.

Concerning the advantages afforded by the timber element of the invention and by its manufacturing procedure, the following additional observations can be made.

It is an advantage of the invention that, thanks to the guiding recess, any cracks which may come up during the curing of the wooden blank will be directed to run to a surface provided with a guiding recess. The guiding recesses of the wooden blanks elicit the same effect in the completed timber element, and therefore the cracking ensuing on the timber element's drying will take place in the vertical direction of the timber element, most advantageously in its interior and/or onto the top and/or bottom face of the timber element. Thereby the side faces of the timber element and the surfaces of any walls that have been erected of timber elements are kept substantially faultless and, in particular, free of major cracks.

It is a further advantage of the invention that the logs which constitute the raw material for the timber element can be cut up into wooden blanks of desired breadth and height, of which the timber element is composed, in one single work step. It is a further advantage that it also becomes possible to cut the log up more closely not only into wooden blanks for use in making timber elements but also into other types of useful timber. It is thus understood that the wooden blanks are sawn to desired dimensions in one go, whereafter they are provided, while still green, with one or two guiding recesses, which are positioned on predetermined faces, on the whole on flat sides which will be located inside the timber element and/or on its top and/or bottom face. Subsequent to curing, the wooden blank is planed on the faces meant to be glued, and the timber element blank assembled of glued-together wooden blanks is planed/dressed to obtain the desired sectional configuration, or profile.

It is a further advantage of the invention that the timber element retains its strength in spite of the guiding recesses used to guide the splitting, and of any cracks that may form, and that the timber element keeps straight and its characteristics remain similar to those of a piece of timber made of a single wooden blank, because the wooden blanks making up the timber element are glued together in the horizontal plane.

It is also an advantage of the invention that it is possible by the aid of the procedure to manufacture timber elements of gross dimensions, e.g. 225 mm by 450 mm.

BRIEF DESCRIPTION OF THE DRAWINGS

In the following the invention is described with the aid of attached drawings, wherein.

DETAILED DESCRIPTION OF THE PREFERRED EMBODIMENT

Figure 5A:
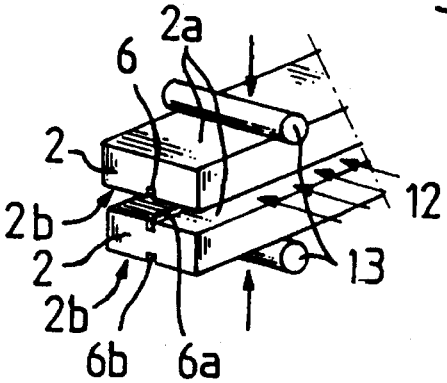
FIG. 5*a* shows the gluing together of two wooden blanks by their planed flat faces.
Figure 5B:
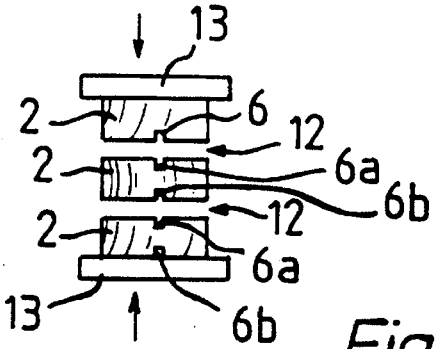
FIG. 5*b* shows the gluing together of three wooden blanks by their planed flat faces.
Figure 6A:
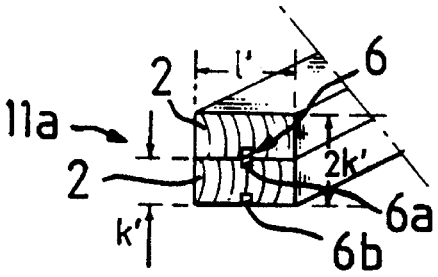
FIG. 6*a* presents a timber element blank composed of two wooden blanks.
Figure 6B:
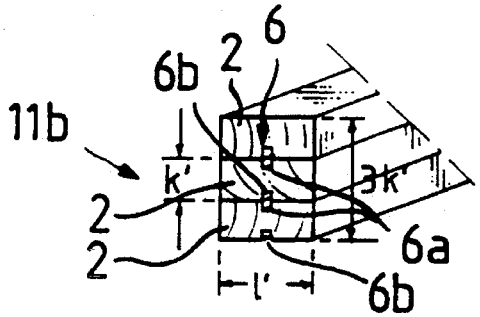
FIG. 6*b* presents a timber element blank composed of three wooden blanks.
Figure 7A:
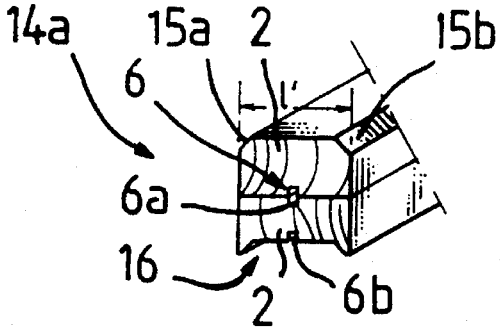
FIG. 7*a* presents a completed timber element dressed to prescribed sectional configuration (profile) and which is composed of two wooden blanks.
Figure 7B:
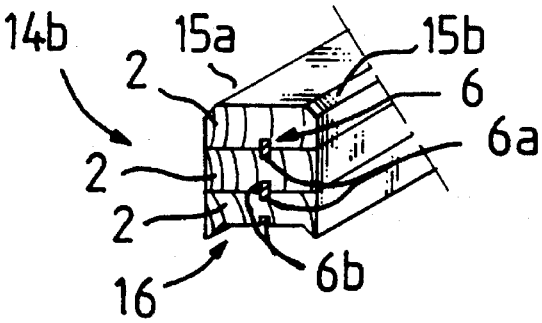
FIG. 7*b* presents a timber element composed of three wooden blanks and dressed to prescribed profile.

FIGS. 1, 2*a*, 3, 4*a*, 5*a* and 6*a* illustrate a procedure conforming to the invention serving to manufacture a timber element as shown in FIG. 7*a*. Similarly, FIGS. 1, 2*b*, 3, 4*b*, 5*b* and 6*b* illustrate a procedure conforming to the invention serving to manufacture a timber element as shown in FIG. 7*b*.

Figure 1:
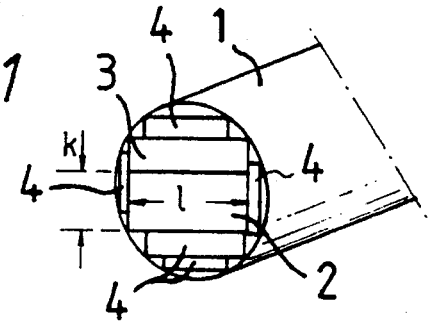
FIG. 1 presents, schematically, a log and the parts into which it is cut.

In FIG. 1 is depicted a log 1, with the cutting plan perspicuously traced on its end face. It is meant to cut the log up into a wooden blank, or batten, 2, of which the breadth 1 and height k have been selected in advance. The breadth 1 of the wooden blank is substantially consistent with the breadth of the timber element to be manufactured, taking into account the curing and machining allowances. The height k of the wooden blank is substantially one half or one third of the height of the ultimate timber element, accounting for the same allowances. Thus, the breadth 1 of the wooden blank is as a rule greater than its height k, in other words, the blank has a rectangular cross section. In addition, another batten 3 and a number of boards 4 can be cut from the log.

When all cutting dimensions, 1×k, of the wooden blank have been fixed, it can naturally be cut from any log which is compatible with its dimensions. All the rest of wood material that will be obtained from the log 1 can be utilized towards various forms of sawn timber, as battens, boards, etc.

Figure 2A:
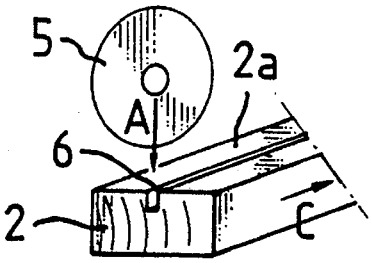
FIG. 2*a* presents, schematically, the disposition of a guiding recess on one flat face of the wooden blank and FIG. 2*b*, similarly, on two opposed flat faces of the wooden blank.
Figure 2B:
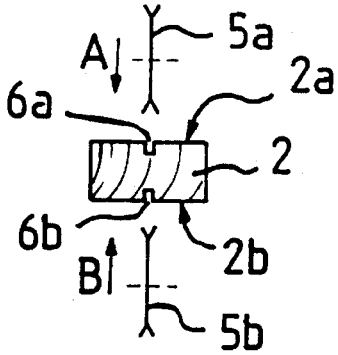
Figure 3:
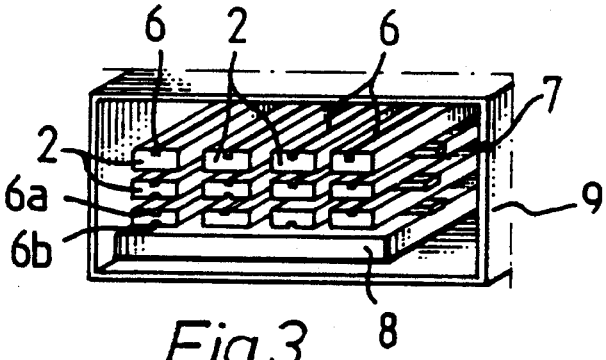
FIG. 3 illustrates the drying (curing) of wooden blanks.

FIG. 2 shows, perspicuously, the disposition of the guiding recess on the wooden blank 2. In FIG. 2*a* a guiding recess 6 has been machined in one broad, or flat side 2*a* of the wooden blank 2*a*, entering the wood from the direction of arrow A with the blade means 5. In FIG. 2*b*, guiding recesses 6*a*,6*b* have similarly been machined with blade means 5*a*,5*b* in two opposed flat sides 2*a*,2*b* of the wooden blank 2, proceeding in the direction of arrows A,B. The flat faces 2*a*,2*b* will be substantially horizontal surfaces in the completed timber element. These guiding recesses 6; 6*a*,6*b* have been disposed in the longitudinal direction C of the wooden blank 2 and substantially in the centre of the flat face 2*a*,2*b*. The guiding recesses 6; 6*a*,6*b* are machined in the green timber, e.g. in connection with cutting up.

The wooden blanks 2 which have been sawn and provided with one guiding recess or with several guiding recesses 6*a*,6*b* are cured. This may be done applying any methods and equipment whatsoever intended for timber drying (curing) known in the art. The wooden blanks may, for instance, be assembled into curing stacks 7 with spacer inserts, the stacks being transported on a carriage 8 into the drying chamber 9 for curing in an appropriate artificial atmosphere, as has been perspicuously shown in FIG. 3.

Figure 4A:
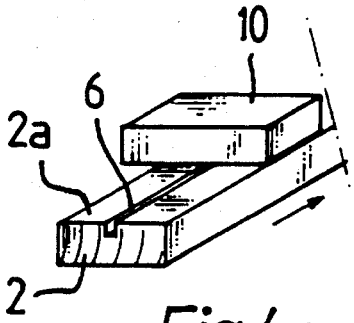
FIG. 4*a* shows the planing of one flat of the wooden blank and FIG. 4*b*, the planing of its opposed flats.
Figure 4B:
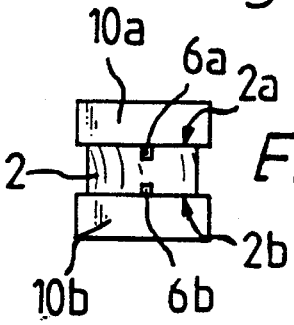

Subsequent to drying, the wooden blanks are taken to be processed for manufacturing timber elements. FIG. 4*a* illustrates the planing of one flat side 2*a* of the wooden blank 2, using a suitable planing apparatus 10. Similarly, FIG. 4*b* illustrates the planing of both flat sides 2*a*,2*b* of the wooden blank 2, using planing apparatus 10*a*,10*b*. The purpose with planing is to rectify those surfaces of the wooden blank which will be joined together in the next work steps. Planing the top and bottom sides of the timber element to be manufactured is not necessary as a rule.

FIGS. 5*a*,5*b* illustrate the assembly of a timber element blank by gluing and pressing of two wooden blanks 2 and of three wooden blanks 2, respectively. A glue course 12 is provided between the surfaces to be joined of the wooden blanks 2, and the blanks are thereafter pressed together in a press means 13 and, if necessary, heated in order to accelerate the curing of the glue. The wooden blanks 2 may be glued together using any method of prior art whatsoever, such methods being known for instance in the manufacturing of glued timber beams.

In FIG. 6*a* is depicted a timber element blank 11*a* composed of two wooden blanks 2 and in FIG. 6*b*, a timber element blank 11*b* composed of three wooden blanks 2. These timber element blanks are then machined into timber elements 14*a*,14*b* with such profile as may be required, e.g. by bevelling the top edges (15*a*,15*b*) in a cutter mill and making a relief 16 on the underside, as can be seen for instance in FIG. 7*a* and 7*b*, respectively.

The timber element blanks 11*a*,11*b* have in this instance been dressed into timber elements 14*a*,14*b* having a profile like that of a dressed timber. The breadth 1 of the initial wooden blank 2 is, for instance, 225 mm and corresponds also substantially to the breadth 1' of the timber element in FIGS. 6*a* and 6*b*. The allowances for machining and curing are on the order of 1 mm as a rule. Similarly, the height k of the wooden blank 2, in the log-cutting situation, is e.g. on the order of 150 mm, and this also substantially corresponds to the height k' of the wooden blank 2 in the dressed timber element 14*a*,14*b* in FIGS. 7*a* and 7*b*. The height of the timber element 14*a* in FIG. 7*a* will then be 2×k', or 300 mm, while the timber element of FIG. 6*b* will have a height of 3×k', or 450 mm.

Figure 8:
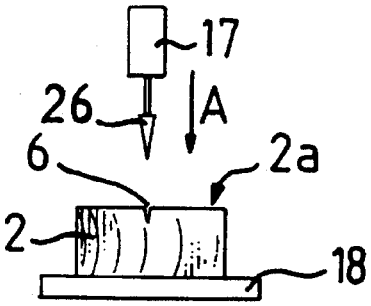
FIG. 8 shows, schematically, the way in which a conical guiding recess is produced in the wooden blank.

In FIG. 8 is perspicuously shown a means for producing a guiding recess 6; 6*a*,6*b* in the wooden blank 2. This means enables the guiding recess to be rapidly and conveniently machined in the wooden blank. The means comprises a conical blade component 26, with which the guiding recess 6 is incised virtually at right angles into the flat face 2*a* of the wooden blank 2, to a suitable depth, such as 10 to 30 mm. The taper of the blade component 26 and of the guiding recess 6 has rather been exaggerated in FIG. 8. The blade component 26 is operated with a suitable actuating means, e.g. with a hydraulic driver 17, by means of which it is urged in the direction A, while the wooden blank 2 is transported on a conveyor 18 past this driver, at a suitable distance from it.

Figure 9:
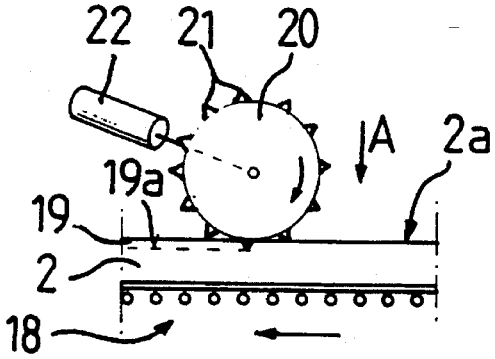
FIG. 9 presents, as seen from one side, the way in which a guiding recess implemented in the form of short recesses is provided on the wooden blank.
Figure 10:
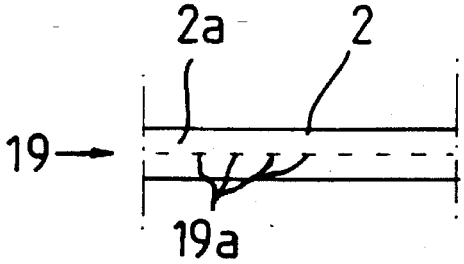
FIG. 10 presents, as viewed from above, a wooden blank provided with a guiding recess composed of short, consecutive recesses.

FIG. 9 illustrates another means for producing a guiding recess 19 in the wooden blank 2. This means comprises a blade wheel 20, radially carrying blade components, such as teeth 21, spaced at a given distance, and a rotating means, such as an electric motor 22. The distance of this means relative to the conveyor 18 is moreover adjustable. When the wooden blank 2 is moved on the conveyor past the blade wheel 20, at a suitable distance therefrom, and the blade wheel 20 is pressed down in the direction A and set in rotation with the electric motor 22, to rotate at a speed which is consistent with the speed at which the wooden blank is being transported, the teeth 21 will sink into the wooden blank 2 with a given mutual spacing, and they will in this manner produce a guiding recess 19. This guiding recess 19 has then been incised in the horizontal face 2*a* of the wooden blank in the form of short serial recesses 19*a*, which are spaced at a given distance. The guiding recess 19 has then been established in the shape of a pricked groove, and it operates in substantially like manner as a continuous guiding recess in the flat, or horizontal, face of the wooden blank.

The invention is not delimited to read exclusively on the embodiment example presented: numerous alterations are feasible while staying within the scope of the inventive idea defined by the claims.

I claim:

1. A timber element, comprising:

at least two heavy wooden blanks, each having a substantially horizontal face, said wooden blanks being fitted one upon the other and said substantially horizontal faces being glued together;

a guiding recess being embossed on at least one of said horizontal faces of the corresponding wooden blanks and disposed between said glued wooden blanks; and the guiding recess being disposed in a longitudinal direction of the corresponding wooden blank, and a depth of the guiding recess being substantially vertical, for guiding a splitting to occur in a vertical direction, to the corresponding wooden blanks, the guiding recess having a plurality of short recesses disposed in a line with a given spacing.

2. A timber element according to claim 1, wherein the guiding recess presents a wedge-shaped cross section.

3. A method for manufacturing a timber element, comprising the steps of:

cutting at least two heavy wooden blanks from logs, each of the heavy wooden blanks providing a horizontal face;

embossing a guiding recess in at least one of the horizontal faces in a longitudinal direction of the corresponding wooden blank, a depth of the guiding recess being in a substantially vertical direction of the corresponding wooden blank, the guiding recess guiding a splitting to occur vertically, which is vertical to the horizontal faces, the guiding recess including a serial of short recesses spaced at a given distance;

planing on the horizontal faces to be glued;

gluing the horizontal faces of at least two wooden blanks, one upon the other, to form a timber element blank;

drying the wooden blanks; and shaping the glued wooden blanks to an ultimate shape by machine, so as to become a desired timber element.

4. A method according to claim 3, wherein the guiding recess shaped in the shaping step presents a conical cross section.

5. A method according to claim 3, wherein the guiding recess shaped in the shaping step is slashed in at least one of the horizontal faces of the corresponding wooden blank.

6. A method according to claim 3, wherein the guiding recess embossed in the embossing step uses a blade wheel on which are radially disposed blade components, such as teeth with a given spacing.

* * * * *